US006935916B2

(12) United States Patent
Sasaki et al.

(10) Patent No.: US 6,935,916 B2
(45) Date of Patent: Aug. 30, 2005

(54) MANUFACTURING METHOD AND MANUFACTURING APPARATUS FOR A GAS DISCHARGE PANEL

(75) Inventors: Yoshiki Sasaki, Shijounawate (JP); Junichi Hibino, Neyagawa (JP); Hiroyosi Tanaka, Kyoto (JP); Akira Shiokawa, Osaka (JP); Masafumi Ookawa, Neyagawa (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 209 days.

(21) Appl. No.: 10/616,153

(22) Filed: Jul. 9, 2003

(65) Prior Publication Data

US 2004/0053555 A1 Mar. 18, 2004

Related U.S. Application Data

(62) Division of application No. 09/869,866, filed on Jul. 5, 2001, now Pat. No. 6,769,946, which is a continuation of application No. PCT/JP00/07918, filed on Oct. 11, 2000.

(30) Foreign Application Priority Data

Nov. 11, 1999 (JP) ..... 11-320529

(51) Int. Cl.[7] ..... H01J 9/32

(52) U.S. Cl. ..... 445/25; 445/22; 445/24

(58) Field of Search ..... 445/22, 24, 25, 445/26, 23, 58, 56, 38

(56) References Cited

U.S. PATENT DOCUMENTS

| | | | |
|---|---|---|---|
| 4,039,881 | A | 8/1977 | Le Coquil et al. |
| 4,139,250 | A | 2/1979 | Jacobs et al. |
| 4,204,721 | A | 5/1980 | Hubert et al. |
| 6,036,568 | A | 3/2000 | Murouchi et al. |
| 6,353,287 | B1 | 3/2002 | Sasaki et al. |
| 6,476,554 | B1 | 11/2002 | Snijkers et al. |

FOREIGN PATENT DOCUMENTS

| | | |
|---|---|---|
| JP | 61071533 | 4/1986 |
| JP | 10040818 | 2/1998 |
| JP | 11233002 | 8/1999 |
| JP | 2000156160 | 6/2000 |
| JP | 2000294133 | 10/2000 |

*Primary Examiner*—Joseph Williams

(57) ABSTRACT

A manufacturing method for a gas discharge panel according to the invention can reduce the amount of water and gaseous molecules, which are absorbed into the first and the second substrates, to a minimum by keeping the both substrates under a reduced pressure, and therefore can prevent a degradation of a discharge gas filling the finished panel. As a result, problems in the finished panel such as increase in a discharge starting voltage and generation of an abnormal discharge can be suppressed.

6 Claims, 8 Drawing Sheets

MANUFACTURING METHOD AND MANUFACTURING APPARATUS FOR A GAS DISCHARGE PANEL

This is a divisional application of U.S. Ser. No. 09/869,866, filed on Jul. 5, 2001, U.S. Pat. No. 6,769,946 which is a continuation of PCT/JP00/07918 filed Oct. 11, 2000.

TECHNICAL FIELD

The present invention relates to a manufacturing method for a gas discharge panel that is composed by attaching a first substrate to a second substrate. More specifically, the present invention relates to a manufacturing method and a manufacturing apparatus for the gas discharge panel, which are characterized by an atmosphere for keeping the both substrates in an alignment step and in the preceding step.

BACKGROUND ART

Conventionally, an AC plasma display panel (hereafter called "PDP") shown in FIG. 8 is known as one example of gas discharge panels. This figure shows a construction of a part of the PDP in perspective view, with certain parts omitted.

The PDP includes an envelope 12 that is composed of a first substrate 5 and a second substrate 10 which are opposed to each other and whose periphery is sealed with a seal member 11 consisting of a low melting glass. The first substrate 5 is formed with a plurality of display electrodes 2, a dielectric layer 3, and a protective layer 4 which are formed on the internal surface of a glass substrate 1. The second substrate is formed with a plurality of data electrodes 7 extending orthogonally to the display electrodes 2, a dielectric layer 8 which are formed on the internal surface of a glass substrate 6. In addition, a plurality of partition walls 9 consisting of a low melting glass are formed at equal spaces and in parallel on the dielectric layer 8 in order to divide an internal space between the two substrates into a light-emitting cell.

Also, a phosphor 13 is applied onto the dielectric layer 8 for each light-emitting cell divided by the partition walls 9 in order to display a color image, and a discharge gas consisting of a mixture of Ne and Xe is enclosed in the envelope 12 with approximately 66,500 Pa of pressure.

In general, the PDP is manufactured by attaching the first substrate 5 to the second substrate 10 which are fabricated by separate steps. The first substrate 5 is prepared in the following manner: that is, the display electrodes are formed on the glass substrate, and a dielectric is applied thereon as a layer and baked. Finally, a film consisting of MgO or the like as the protective layer is formed on the dielectric layer according to an electron-beam evaporation (EB evaporation) method or the like to complete the first substrate 5.

Meanwhile, the second substrate 10 is prepared in the following manner: that is, the data electrodes are formed on a glass substrate, a dielectric is applied thereon as a layer, and the partition walls consisting of a low melting glass are formed in a predetermined pattern. Next, phosphors are applied as a layer between partition walls. Finally, the seal member (normally consisting of a mixture of a flit glass and a binder) is applied onto the periphery of the glass substrate, and pre-baking is performed for driving off the binder included in the seal member to complete the second substrate.

Then, the first substrate and the second substrate fabricated as above are arranged and fixed at predetermined locations with contacting each other, while being heated and sealed to complete the envelope.

Finally, after an internal space within the envelope is evacuated, the space is heated at a predetermined temperature. Then, the discharge gas is enclosed in the space to complete the gas discharge panel.

Here, some finished PDPs which are manufactured by the above-mentioned steps have problems of increase in a discharge starting voltage, generation of an abnormal discharge phenomenon during light-emitting, and so on. These problems result from the following reasons.

Firstly, the MgO layer formed on the first substrate as the protective layer is made up of a plurality of needle shaped molecules which are arranged systematically and substantially vertical to the glass substrate. As such, if water or gaseous molecules are absorbed into these molecules, then it is difficult to remove the water or the gaseous molecules from there.

In the finished panel, the protective layer is exposed to discharge, so that the temperature of the layer becomes high. As a result, the water or the gaseous molecules gradually leak out to the discharge space, which deteriorates the degree of purity of the discharge gas.

Secondly, phosphors formed on the second substrate have an extremely porous structure. Thus, water or gaseous molecules are absorbed into the phosphors as well as the protective layer.

It can be considered that such a deterioration of the degree of purity of the discharge gas causes the above-mentioned problems of increase in the discharge starting voltage and generation of the abnormal discharge phenomenon. Naturally, it is preferable to remove both water and gaseous molecules. However, it is known that effects can be obtained when water only is removed. Therefore, it is preferable that the first substrate after forming a protective layer thereon and the second substrate after a pre-baking of the seal member are not exposed to the air as much as possible. However, it is the current state of the art that such a consideration is not given in the actual PDP manufacturing step.

DISCLOSURE OF THE INVENTION

The object of the present invention is therefore to provide a manufacturing method and a manufacturing apparatus for a gas discharge panel to avoid degradation of the panel properties due to deterioration of the degree of purity of the discharge gas and therefore realize excellent panel properties.

The object can be achieved by a manufacturing method for a gas discharge panel that has a first substrate on which a protective layer is formed and a second substrate on which phosphor layers are formed, and the manufacturing method includes an alignment step for arranging the first substrate and the second substrate at predetermined locations, while opposing the first substrate and the second substrate, wherein the alignment step is conducted under a reduced pressure.

Such an alignment step conducted under a reduced pressure leads to reduction in the amount of water and gaseous molecules which are confined in the internal space in the alignment step, which suppresses problems of increase in the discharge starting voltage and generation of the abnormal discharge phenomenon and therefore realizes excellent panel properties. By the way, the internal space in the finished panel is filled with a discharge gas. Prior to the gas filling step and after the sealing step, it is difficult to effectively exhaust impurities such as water vapor from the space. Especially, when the alignment step is conducted in the air where the content of water vapor is not controlled, the difficulty becomes remarkable. However, the alignment step conducted under a reduced pressure according to the invention can reduce the amount of water vapor which is confined in the internal space in the alignment step. Therefore, a gas discharge panel having excellent panel properties can be obtained.

In addition, in the above manufacturing method, the first substrate is placed under a reduced pressure and heated in a first reduced pressure chamber and/or the second substrate is placed under a reduced pressure and heated in a second reduced pressure chamber, prior to the alignment step in which the first and the second substrates are aligned under a reduced pressure in a third reduced pressure chamber.

As stated above, the above method enables procedures under a reduced pressure for the first substrate and the second substrate to be conducted in different reduced pressure chambers, without the both substrates facing each other. Therefore, this method brings the following effects:

That is, the method can securely prevent water and gaseous molecules which leave one substrate from being absorbed into the other substrate. Therefore, a gas discharge panel having excellent panel properties can be obtained.

Besides, the above method enables water or the like to be removed in a condition suitable for each substrate.

Also, the above method can effectively prevent the possibility that gases due to binder burning generated from the second substrate is absorbed into the first substrate.

Further, the above method enables total surface of each substrate to be uniformly exposed to the reduced pressure.

Here, in the above-mentioned manufacturing method, after the protective layer is formed on the first substrate, the first substrate is subjected to a first substrate baking step in which the first substrate is placed under the reduced pressure and heated in the first reduced pressure chamber.

Here, in the above-mentioned manufacturing method, the second substrate is formed by a phosphor layers forming step, a phosphor layers baking step, a seal member applying step, and a seal member pre-baking step, and the second substrate is placed under the reduced pressure and heated in the second reduced pressure chamber part way through the seal member pre-baking step.

Here, in the above-mentioned manufacturing method, it is preferable that the first and the second reduced pressure chambers are each reduced to a pressure of 1,333 Pa or less.

In addition, according to the invention, a manufacturing method for a gas discharge panel that has a first substrate on which a protective layer is formed and a second substrate on which phosphor layers are formed, and the manufacturing method includes an alignment step for arranging the first substrate and the second substrate at predetermined locations, while opposing the first substrate and the second substrate, wherein the alignment step is conducted in dry gas.

Such an alignment step conducted in dry gas leads to reduction in the amount of water and gaseous molecules which are confined in the internal space in the alignment step, which suppresses problems of increase in the discharge starting voltage and generation of the abnormal discharge phenomenon and therefore realizes excellent panel properties. By the way, the internal space in the finished panel is filled with a discharge gas. Prior to the gas filling step and after the sealing step, it is difficult to effectively exhaust impurities such as water vapor from the space. Especially, when the alignment step is conducted in the air where the content of water vapor is not controlled, the difficulty becomes remarkable. However, the alignment step conducted in dry air according to the invention can reduce the amount of water vapor which is confined in the internal space in the alignment step. Therefore, a gas discharge panel having excellent panel properties can be obtained.

In addition, in the above-mentioned manufacturing method, the first substrate is placed in dry gas and heated in a first dry gas chamber and/or the second substrate is placed in dry gas and heated in a second dry gas chamber, prior to the alignment step in which the first and the second substrates are aligned in dry gas in a third dry gas chamber.

As stated above, the above method enables procedures in dry gas for the first substrate and the second substrate to be conducted in different reduced pressure chambers, without the both substrates facing each other. Therefore, this method brings the following effects:

That is, the method can securely prevent water and gaseous molecules which leave one substrate from being absorbed into the other substrate. Therefore, a gas discharge panel having excellent panel properties can be obtained.

Besides, the above method enables water or the like to be removed in a condition suitable for each substrate.

Also, the above method can effectively prevent the possibility that gases due to binder burning generated from the second substrate is absorbed into the first substrate.

Further, the above method enables total surface of each substrate to be uniformly exposed to the dry gas.

Here, in the above-mentioned manufacturing method, after the protective layer is formed on the first substrate, the first substrate is subjected to a first substrate baking step in which the first substrate is placed in dry gas and heated in the first dry gas chamber.

Here, in the above-mentioned manufacturing method, the second substrate is formed by a phosphor layers forming step, a phosphor layers baking step, a seal member applying step, and a seal member pre-baking step, and the second substrate is placed in dry gas and heated in the second dry gas chamber in the beginning of the seal member pre-baking step.

Here, in the above-mentioned manufacturing method, the first dry gas chamber and the second dry gas chamber are each filled with dry gas whose dew-point is specified to −30° C. or less.

Here, in the above-mentioned manufacturing method, the first substrate is placed under the reduced pressure and heated, and the second substrate is placed in dry gas, before the alignment step is conducted.

According to the above-mentioned manufacturing methods, a gas discharge panel where a water vapor partial pressure in the internal space of the panel is 100 Pa or less can be obtained.

Since such a panel with an extremely low water vapor partial pressure inside of it can be obtained, the degree of degradation in the discharge property resulting from water is small even when an ambient temperature for the panel is decreased.

In addition, the invention relates to a manufacturing apparatus for a gas discharge panel having a first substrate carrying mechanism, a second substrate carrying mechanism, and an alignment mechanism, wherein each mechanism is provided in different hermetically sealed chambers, which each include at least one of a gas supplying mechanism and a gas exhausting mechanism.

As stated above, the above apparatus enables procedures under a reduced pressure or in dry gas for the first substrate and the second substrate to be conducted in different and sufficiently separated reduced pressure chambers, without the both substrates facing each other. Therefore, this apparatus brings the following effects:

That is, the apparatus can securely prevent water and gaseous molecules which leave one substrate from being absorbed into the other substrate. Therefore, a gas discharge panel having excellent panel properties can be obtained.

Besides, the above apparatus enables water or the like to be removed in a condition suitable for each substrate.

Also, the above apparatus can effectively prevent the possibility that gases due to binder burning generated from the second substrate is absorbed into the first substrate.

Further, the above apparatus enables total surface of each substrate to be uniformly exposed to reduced pressure or dry gas.

Here, in the above-mentioned manufacturing apparatus, connecting units are provided between the chamber including the first substrate carrying mechanism and the chamber including the alignment mechanism and between the chamber including the second substrate carrying mechanism and the chamber including the alignment mechanism, and each connecting unit has at least one of a gas supplying mechanism and a gas exhausting mechanism in it.

BEST MODE FOR CARRYING OUT THE INVENTION

The following describes embodiments of the invention, with reference to the attached figures.

[Embodiment 1]

Figure 1:
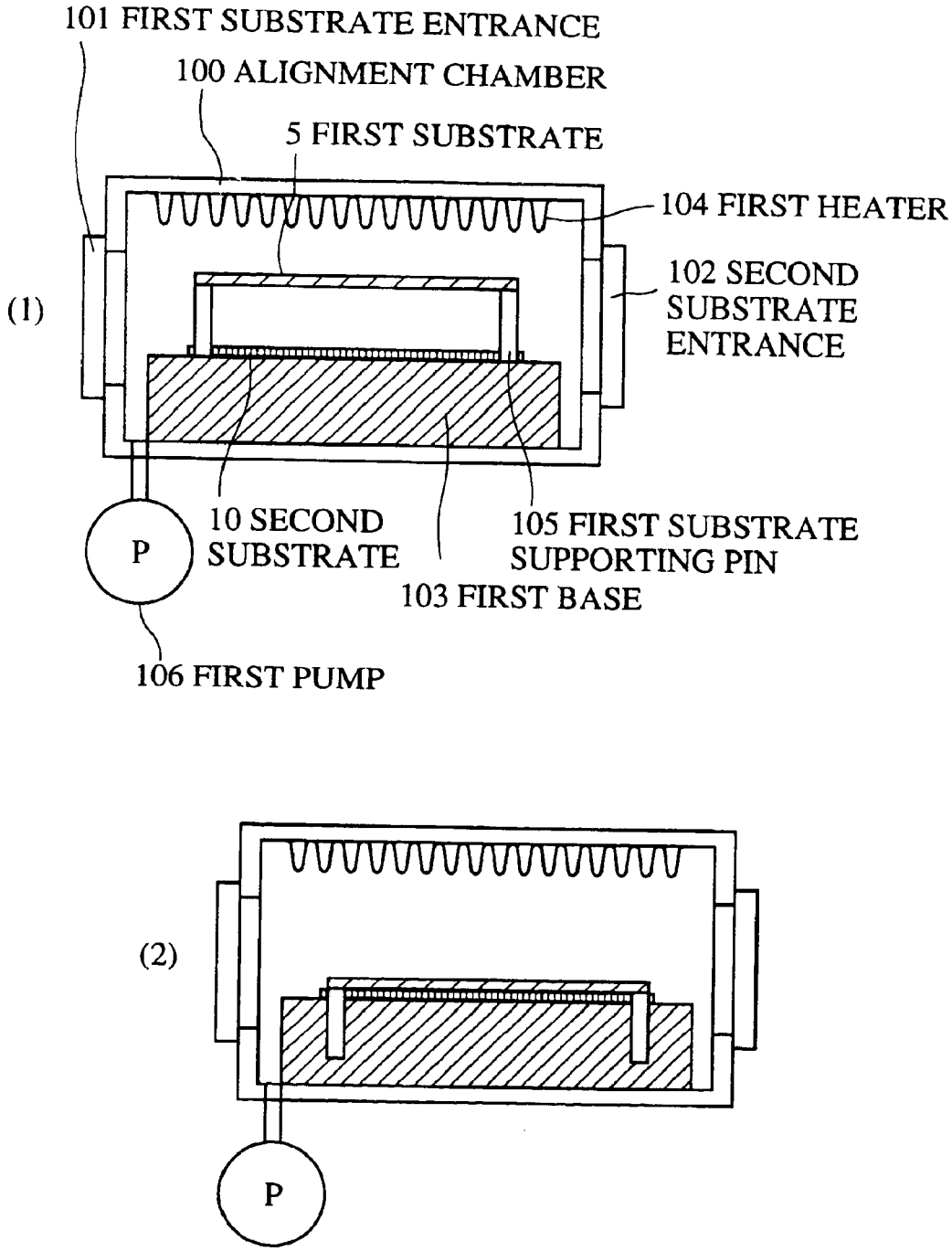
FIG. 1 is a sectional view showing a simplified manufacturing method for a PDP according to the first embodiment of the invention.

FIG. 1 is a sectional view showing a simplified manufacturing method for a PDP according to the first embodiment of the invention.

Figure 8:
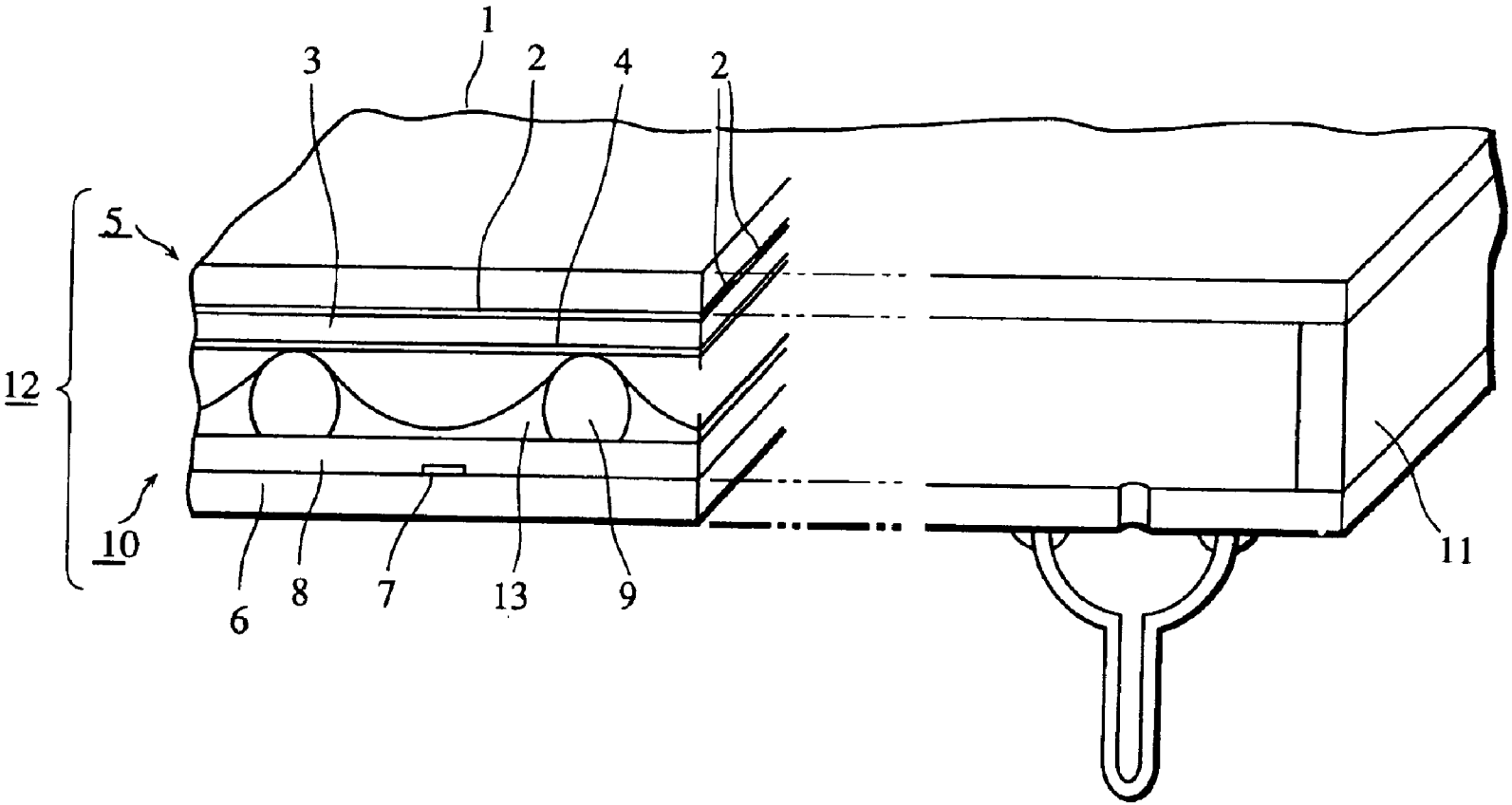
FIG. 8 is a perspective view, with portions in a cutaway view for clarity, showing a simplified construction of the conventional PDP and the PDP according to the embodiment of the invention.

Here, an overall construction of the PDP according to the embodiment basically equals to the conventional one, with the same reference numerals being given to the same components or parts shown in FIG. 8. (This will also apply to the following embodiments).

Since this embodiment is characterized by an alignment step and the preceding step, these steps will be described using FIG. 1.

In FIG. 1, the numerals 100, 101, 102, 103, 104, 105, and 106 refer to an alignment chamber, a first substrate entrance, a second substrate entrance, a first base, a first heater, a set of first substrate supporting pins, and a first vacuum pump, respectively. The alignment chamber 100 has a hermetically sealed structure so as to keep the internal space in a hermetic state.

The first substrate 5 is prepared in the following manner: that is, an Ag paste or the like is applied on a glass substrate and baked to form display electrodes, a dielectric consisting of a low melting glass is formed thereon and baked, and a protective layer consisting of MgO is formed according to an EB evaporation method or the like and baked at a predetermined temperature, prior to the alignment step.

Meanwhile, the second substrate 10 is prepared in the following manner: that is, an Ag paste or the like is applied on a glass substrate and baked to form address electrodes, a dielectric consisting of a low melting glass is formed thereon and baked, and partition walls consisting of a low melting glass is formed in a predetermined shape and baked. Next, phosphors are formed between the partition walls in a predetermined pattern and baked. Finally, a paste (a mixture of a flit glass, a binder, and a solvent) as a seal member is applied to the periphery of the second substrate and at portions where the second substrate and the first substrate 5 overlap each other using a dispenser or the like, and pre-baked at a predetermined temperature to remove a binder included in the paste.

In FIG. 1(1), the first substrate 5 is carried in through the first substrate entrance 101 and temporarily placed on the first substrate supporting pins 105. Next, the second substrate 10 is carried in through the second substrate entrance 102 and temporarily placed at a predetermined location on the first base 103.

Then, the pressure of the internal space of the alignment chamber 100 is reduced using the first vacuum pump 106, while keeping an enough interval between the first substrate 5 and the second substrate 10. By reducing the pressure inside of the chamber, water and gaseous molecules which are absorbed into the surfaces of the first substrate 5 and the second substrate 10 are removed from there. Here, as for the degree of the reduced pressure, it is preferable to be set at a lower pressure. In fact, however, it is preferable to be at 1,333 Pa or less, and more preferable to be at 133 Pa or less.

In addition, water and gaseous molecules (i.e., impurities in the discharge gas) can be more effectively removed by heating the inside of the alignment chamber 100 to, for example, approximately 350° C. using the first heater 104.

Next, as shown in FIG. 1(2), the first substrate supporting pins 105 are slowly lowered so that a portion of members which makes up the first substrate 5 comes into contact with a portion of members which makes up the second substrate 10. Finally, the first substrate 5 and the second substrate 10 are each aligned with the predetermined locations by recognizing their alignment marks formed on the first and the second substrates 5 and 10 using a camera or the like (this step is not shown).

By conducting the alignment step under a reduced pressure in this way, the amount of water and gaseous molecules which are confined in the internal space of the panel during the step can be reduced.

As a result, problems of increase in the discharge starting voltage and generation of the abnormal discharge phenomenon can be suppressed and therefore a PDP with excellent panel properties can Le obtained.

Here, after the alignment step, it is more preferable to transfer the panel to the following sealing step (not shown) while keeping the panel under a reduced pressure, because the envelope can be formed so as to minimize the chance that the water and the gaseous molecules are absorbed into the both substrates again.

[Embodiment 2]

Figure 2:
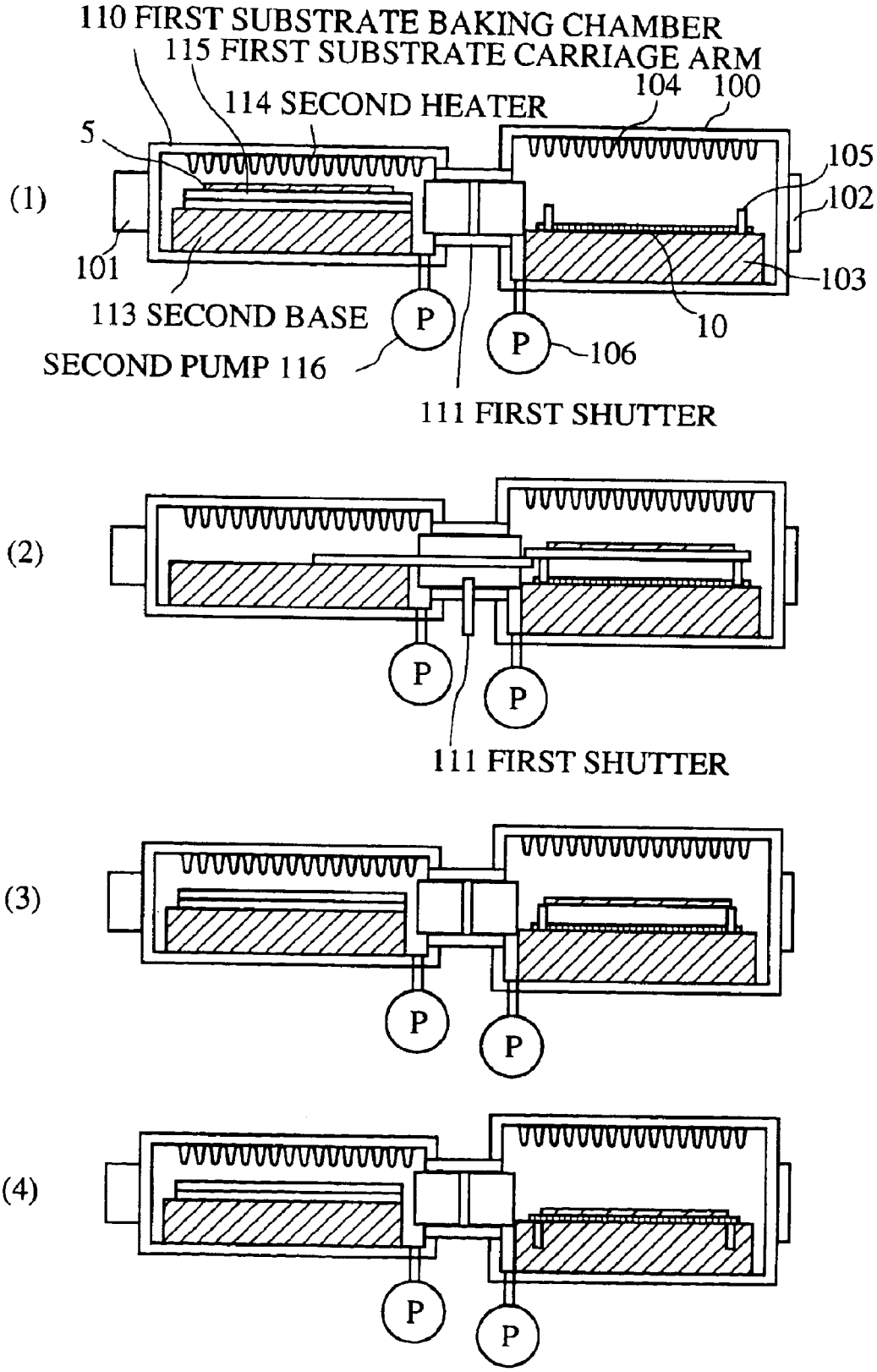
FIG. 2 is a sectional view showing a simplified manufacturing method for a PDP according to the second embodiment of the invention.

FIG. 2 shows distinctive steps of the manufacturing method according to the second embodiment of the invention. In this embodiment, the first substrate 5 is subjected to a step for removing water or the like under a reduced pressure in a different chamber from the alignment chamber (hereafter this step referred to as a "the first substrate baking step"). After that, the first substrate is subjected to the alignment step as described in the first embodiment. In FIG. 2, numerals 110, 113, 114, 115, and 116 refer to a first substrate baking chamber, a second base, a second heater, a first substrate carrier arm, and a second pump, respectively. The first substrate baking chamber has a hermetically sealed structure.

In FIG. 2(1), the first substrate 5 on which the protective layer has been formed is carried into the first substrate baking chamber 110 through the first substrate entrance 101, and is placed at a predetermined location on the first substrate carriage arm 115.

Meanwhile, the second substrate on the periphery of which a seal member is applied and temporarily baked is placed at a predetermined location on the first base 103 in the alignment chamber 100.

Here, the inside of the first substrate baking chamber 110 is reduced in pressure using the second pump, while heating at a predetermined temperature using the second heater 114. Alternatively, the inside of the first substrate baking chamber 100 may be reduced in pressure using the first pump 106, and maybe heated using the first heater 104. In this case, however, when the first shutter 111 is opened, the first substrate baking chamber 110 and the alignment chamber 100 are connected with each other. Therefore, it is preferable to adjust various conditions such as the degree of vacuum and the temperature of the both chambers so as not to be influenced by the other chamber's environment.

Next, as shown in FIG. 2(2), the first shutter 111 is opened, the first substrate carrier arm 115 which carries the first substrate 5 is slid into the alignment chamber 100, the first substrate 5 is placed on the first substrate supporting pins 105, the first substrate carrier arm 115 is returned into the first substrate baking chamber 110, and the first shutter 111 is closed. Here, the first substrate carrier arm 115 will not be described in detail, but the substrate loading surface is fixed to the height of the top end of the first substrate supporting pins 105 and the arm 115 has a mechanism so as to move back and forth while keeping the height. Thereby, the driving system and the control system of the arm can be simplified. Naturally, as far as the first substrate can be accurately placed on the first substrate supporting pins, the arm may has any mechanisms (this will be applicable to the following carrier arm).

Finally, the inside of the alignment chamber 110 is reduced in pressure and heated in the same manner as the first embodiment.

As described above, water and gaseous molecules are removed in the different chamber from the alignment chamber for aligning the first substrate 5 and the second substrate 10. As a result, this method enables water and gaseous molecules which are absorbed in the molecules of the protective layer to be removed, as well as preventing water and gaseous molecules left the surface of a substrate from being absorbed again into-the first substrate or the second substrate. Therefore, this method further improves the panel properties.

[Embodiment 3]

Figure 3:
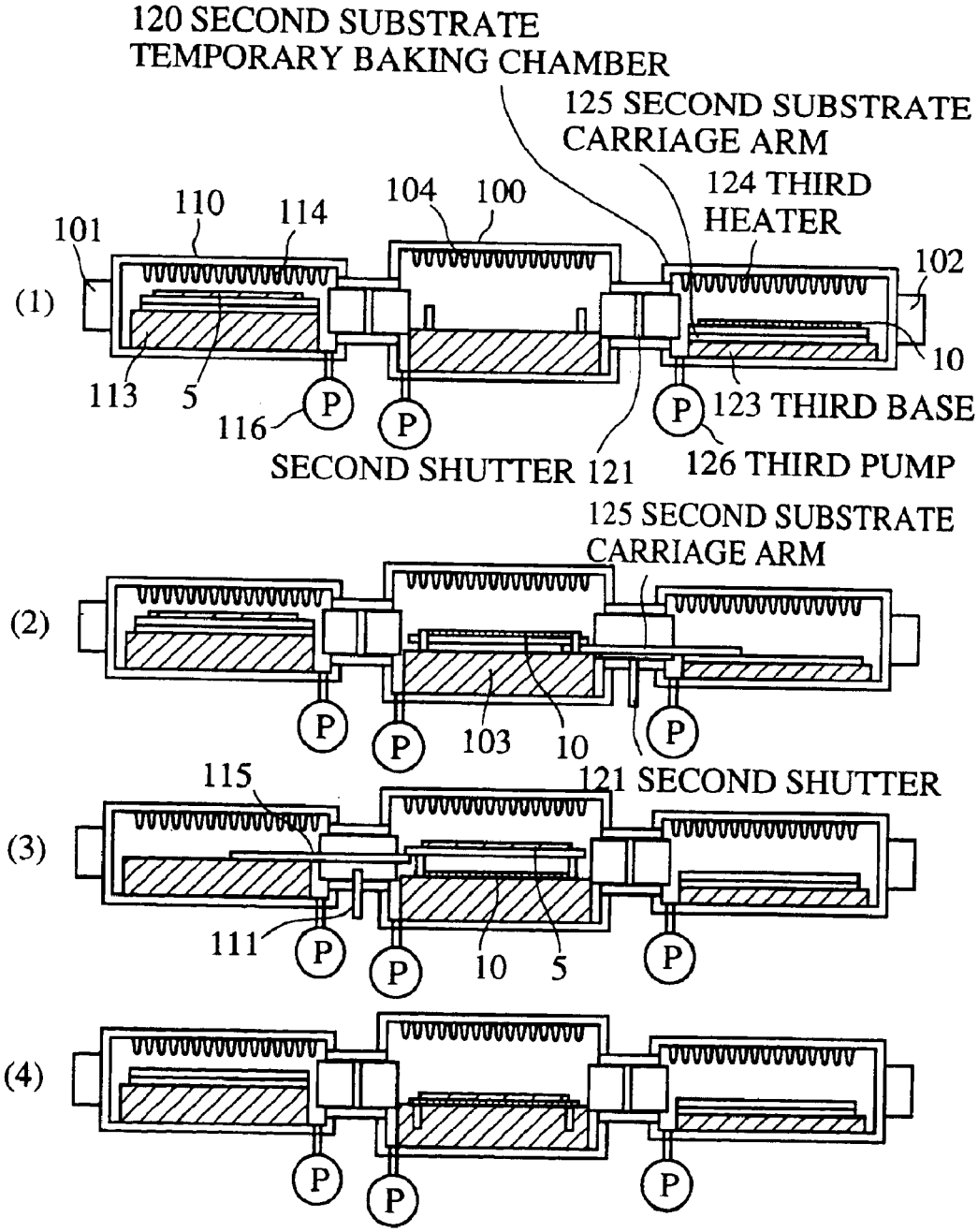
FIG. 3 is a sectional view showing a simplified manufacturing method for a PDP according to the third embodiment of the invention.

FIG. 3 shows distinctive steps of the manufacturing method according to the third embodiment of the invention.

In FIG. 3, numerals 120, 121, 123, 124, 125, and 126 refer to a second substrate pre-baking chamber, a second shutter, a third base, a third heater, a second substrate carriage arm, and a third pump, respectively. The second substrate pre-baking chamber 120 has a hermetically sealed structure.

In FIG. 3(1), the second substrate 10 on the periphery of which a paste as a sealing member is applied is carried in through the second substrate entrance 102, and is placed at a predetermined location on the second substrate carriage arm 125. Next, the second substrate 10 is temporarily baked by heating the inside of the second substrate pre-baking chamber 120 using the third heater 124.

Then, the inside of the second substrate pre-baking chamber 120 is reduced in pressure using the third pump 126 at a predetermined temperature during the cooling period after a peak temperature for the pre-baking. Next, after cooling the second substrate 10, as shown in FIG. 3(2), the second shutter 121 is opened, the second substrate carriage arm 125 which carries the second substrate 10 is slid into the alignment chamber 100, and the second substrate 10 is placed at a predetermined location on the first base 103.

In the above step, the inside of the alignment chamber 100 may be under a reduced pressure beforehand or may be heated beforehand. In addition, the second substrate 10 may be carried before the second substrate 10 is cooled to a room temperature.

FIGS. 3(3) and (4) show the same steps as the baking step of the first substrate 5 described in the above second embodiment.

In general, the second substrate 10 cannot be placed under a reduced pressure from the beginning of the pre-baking step, because oxygen needs to be included in the atmosphere in order to drive off a binder included in the paste as the seal member. Therefore, the second substrate 10 is placed under a reduced pressure after driving off the binder in this embodiment, whereby the amount of water and gaseous molecules which are absorbed into the second substrate 10 can be reduced.

Further, in this embodiment, the steps for the first substrate and the second substrate under a reduced pressure (steps performed in the chambers 110 and 120) are performed in the different chambers without the both substrates being opposed to each other. Thus, this method can securely prevent water and gaseous molecules which leave one substrate from being absorbed again into the other substrate, and therefore can realize a PDP with excellent panel properties.

In addition, the first substrate and the second substrate are placed under a reduced pressure in the different chambers in this embodiment. Therefore, conditions of pressure and temperature can be set for each substrate according to each property, which further improves panel properties. That is, the temperatures for water to leave the first and the second substrates are different from each other. Generally, a higher temperature and a higher degree of vacuum are required for the first substrate, because the MgO layer on the first substrate has a stronger adhesiveness to water molecules. Thus, if the first and the second substrates are placed under the conditions on pressure and temperature suitable for the first substrate, then the phosphors formed on the internal surface of the second substrate may be dispersed due to the absorption power of the pump, or the seal member on the second substrate may be deteriorated. In view of such matters, the first and the second substrates are placed under a reduced pressure in the different chambers in this embodiment. As a result, water or the like can be removed under a suitable condition for each substrate.

More specifically, considering water removal, it is preferable to be at 1,333 Pa or less of pressure for the first and the second substrates, which is the same as in the alignment step, and is more preferable to be at 133 Pa or less. As for temperature, it is preferable to be at approximately 500° C. for the first substrate, while being preferable to be approximately at 450° C. for the second substrate, because the softening point of the flit glass as the seal member is approximately 450° C.

Unlike the embodiment, it can be thought that the first and the second substrates are baked in the same chamber with the both substrates being opposed to each other in order to simplify the manufacturing facilities. In this case, however, there is a high probability that an organic component from the binder is absorbed into the internal surface of the first substrate during a pre-baking of the seal member applied on the second substrate and remains in the finished panel as an impurity for the discharge gas. On the contrary, the method according to this embodiment can reduce such a probability, because the first and the second substrates are placed under a reduced pressure in the different chambers and separated from each other.

In addition, according to this embodiment, total surface of each substrate can be uniformly exposed to the reduced pressure by placing the first and the second substrates in the different chambers. Therefore, it becomes easy to uniformly remove water or the like from the surface of the substrate.

[Embodiment 4]

Since the fourth embodiment is characterized by an alignment step and the preceding step as well as the first embodiment, these steps will be described using FIG. 4.

Figure 4:
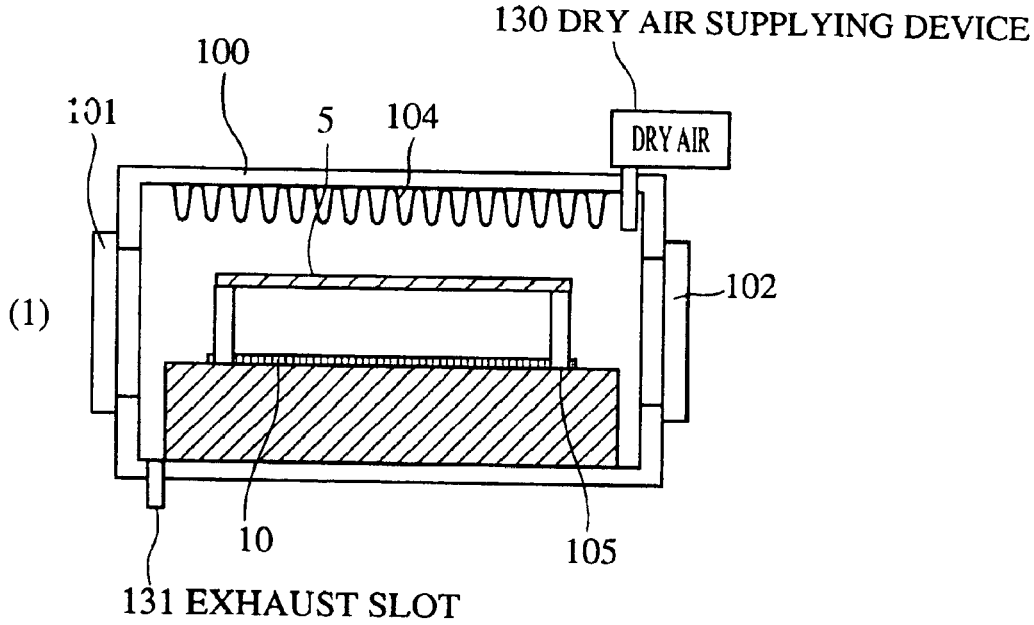
FIG. 4 is a sectional view showing a simplified manufacturing method for a PDP according to the fourth embodiment of the invention.
Figure 4:
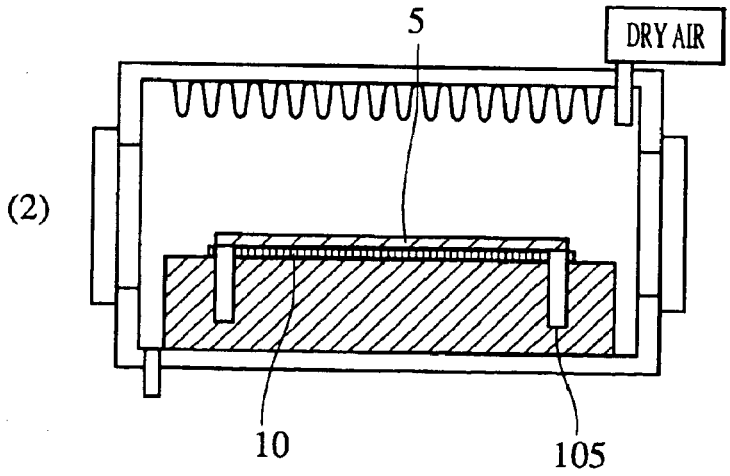

In FIG. 4, the construction is almost the same as in FIG. 1, but a dry air supplying device 130 is provided instead of the first pump 106 in FIG. 1 and an exhaust slot 131 is provided.

In FIG. 4(1), the first substrate 5 is carried in through the first substrate entrance 101 and temporarily placed on the first substrate supporting pins 105. Next, the second substrate 10 is carried in through the second substrate entrance 102 and temporarily placed at a predetermined location on the first base 103.

Next, dry air is supplied into the inside of the alignment chamber 100 using the dry air supplying device 130, while keeping an enough interval between the first substrate 5 and the second substrate 10.

Here, dry air is air from which water is sufficiently removed. This dry air is obtained by pulling air through a hygroscopic member or by pulling air into cryogenic fluid such as liquid nitrogen to freeze and remove the water in the air. The flow of the dry air can prevent water from being absorbed into the surfaces of the first and the second substrates 5 and 10. Naturally, it is preferable to use dry air with a low dew-point, because such a dry air can reduce a large amount of water which is absorbed into the substrate. However, it is preferable to be at least at −30° C. or less, and more preferable to be at −60° C. or less.

In the embodiment, water and gaseous molecules can be more effectively removed from the both substrates by heating the inside of the alignment chamber 100 to approximately 350° C. using the first heater 104.

[Embodiment 5]

Since the fifth embodiment is characterized by an alignment step and the preceding step as well as the third embodiment, these steps will be described using FIG. 5.

Figure 5:
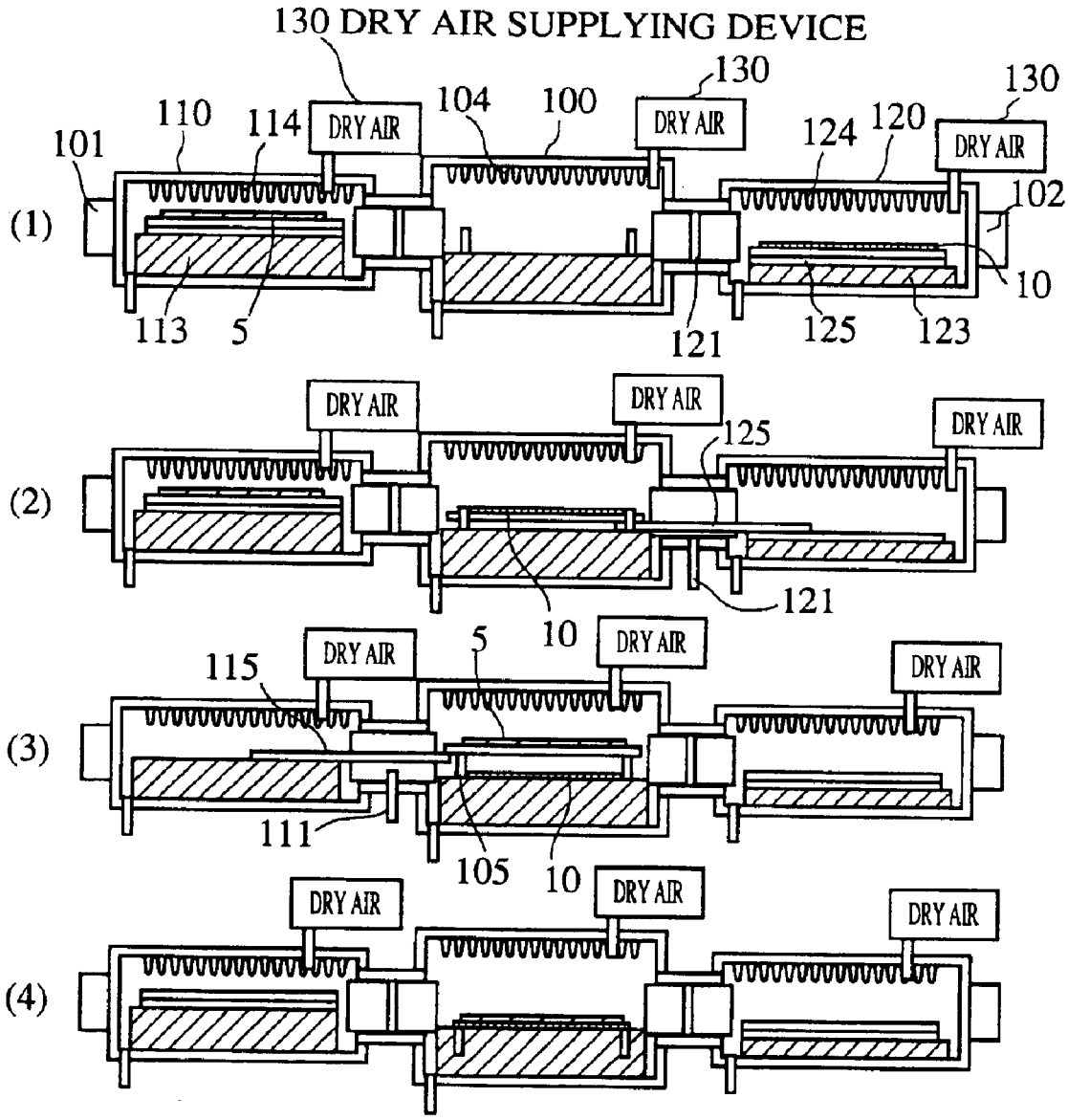
FIG. 5 is a sectional view showing a simplified manufacturing method for a PDP according to the fifth embodiment of the invention.

The construction shown in FIG. 5 is almost the same as the third embodiment shown in FIG. 3, but different in that dry air supplying devices 130 are provided for each chamber instead of the vacuum pumps 106, 116, and 126, and an exhaust slot 131 is provided.

In FIG. 5(1), the second substrate 10 on the periphery of which a paste as a seal member is applied is carried in through the second substrate entrance 102 and placed at a predetermined location on the second substrate carriage arm 125, while consistently supplying dry air into the chamber from the dry air supplying device 130.

Next, pre-baking is performed by heating the inside of the second substrate pre-baking chamber 120 using the third heater 124.

Meanwhile, the first substrate 5 on which the protective layer has been formed is carried into the first substrate baking chamber 110 through the first substrate entrance 101 and placed at a predetermined location on the first substrate carriage arm 115.

In the above step, dry air is supplied into the first substrate baking chamber from the dry air supplying device 130. Next, the inside of the first substrate baking chamber 110 is heated at a predetermined temperature using the second heater 114 while supplying dry air.

Next, after cooling the second substrate 10, as shown in FIG. 5(2), the second shutter 121 is opened, the second substrate carriage arm 125 on which the second substrate 10 is carried is slid into the alignment chamber 100, and the second substrate 10 is placed at a predetermined location on the first base 103. Here, it is preferable that dry air is always supplied into the alignment chamber 100 from the dry air supplying device 130.

Next, as shown in FIG. 5(3), the first shutter 111 is opened, the first substrate carriage arm 115 on which the first substrate 5 is carried is slid into the alignment chamber 100, and the first substrate 5 is placed on the first substrate supporting pins 105. After that, the first substrate carriage arm 115 is returned into the first substrate baking chamber 110 and the first shutter 111 is closed.

Next, as shown in FIG. 5(4), the first substrate supporting pins 105 are slowly lowered so that a portion of members which makes up the first substrate 5 comes into contact with a portion of members which makes up the second substrate 10, while supplying dry air into the alignment chamber 100 from the dry air supplying device 130. Finally, the first substrate 5 and the second substrate 10 are each aligned with the predetermined locations by recognizing their alignment marks formed on the first and the second substrates 5 and 10 using a camera or the like (this step is not shown).

Here, after the alignment step, it is more preferable to transfer the panel to the following sealing step (not shown) while keeping the panel under a reduced pressure, because the envelope can be formed so as to minimize the chance that water and gaseous molecules are absorbed into the both substrates again.

By conducting the baking step for the first and the second substrates in dry gas in this way, the amount of water and gaseous molecules which are absorbed into the both substrates prior to the alignment step can be reduced.

Further, in this embodiment, the steps for the first substrate and the second substrate in dry air (steps performed in the chambers 110 and 120) are performed in the different chambers without the both substrates being opposed to each other. This method can securely prevent water and gaseous molecules which leave one substrate from being absorbed again into the other substrate, and therefore can realize a PDP having excellent panel properties.

In addition, the first substrate and the second substrate are placed in dry air in the different chambers in this embodiment. Therefore, a kind of dry gas, a flow rate of the gas, and a temperature can be set for each substrate according to each property, which further improves panel properties. That is, the temperatures for water to leave the first and the second substrates are different from each other. Generally, a higher temperature and a higher degree of vacuum are required for the first substrate, because the MgO layer on the first substrate has a stronger adhesiveness to water molecules. Thus, if the both first and the second substrates are placed under conditions on the dry gas flow rate and the temperature suitable for the first substrate, then the phosphors formed on the internal surface of the second substrate may be dispersed due to the gas flow, or the seal member on the second substrate may be deteriorated. Besides, it is known that the phosphors formed on the second substrate tends to thermally degrade due to oxygen deficit. Therefore, it is preferable to use dry gas including oxygen for the process of the second substrate. In view of such matters, the first and the second substrates are placed in dry gas in the different chambers in this embodiment. As a result, water or the like can be removed for suitable conditions for each substrate.

Unlike the embodiment, it can be thought that the first and the second substrates are baked in the same chamber with the both substrates being opposed to each other in order to simplify the manufacturing facilities. In this case, however, there is a high probability that an organic component from the binder is absorbed into the internal surface of the first substrate as an organic component during a pre-baking of the seal member applied on the second substrate and remains in the finished panel as an impurity for the discharge gas. On the contrary, the method according to this embodiment can reduce such a probability, because the first and the second substrates are placed in dry gas in the different chambers and separated from each other.

In addition, according to this embodiment, total surface of each substrate can be uniformly exposed to dry air by placing the first and the second substrates in the different chambers. Therefore, it becomes easy to uniformly remove water or the like from the surface of the substrate.

[Embodiment 6]

Figure 6:
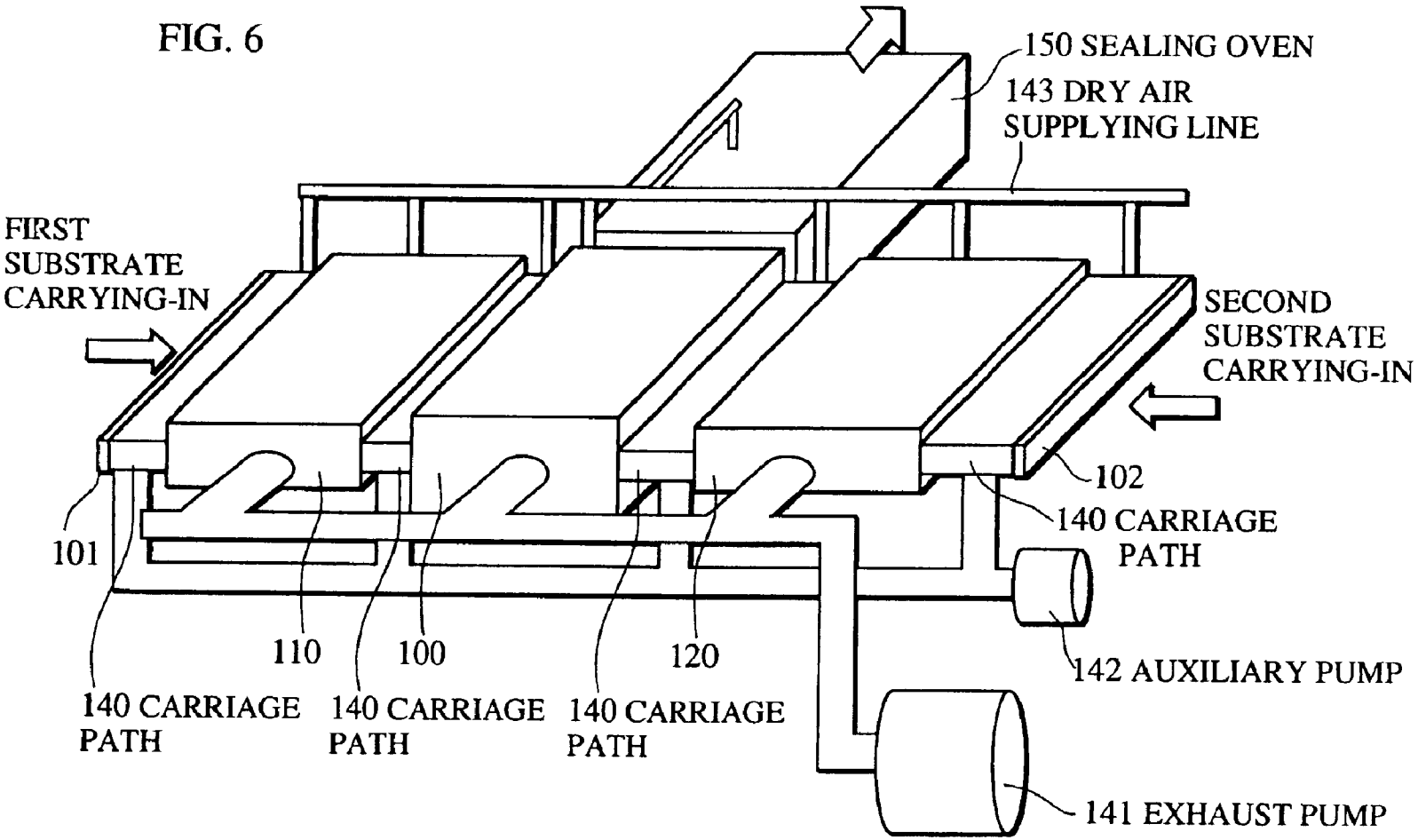
FIG. 6 is a sectional view showing a simplified manufacturing method for a PDP according to the sixth embodiment of the invention.

The following describes a manufacturing apparatus for a PDP according to the sixth embodiment of the invention using FIG. 6. As shown in FIG. 6, the apparatus has a structure in which the alignment chamber 100 is connected to the first substrate baking chamber 110 and the second substrate pre-baking chamber 120, as well as to a sealing oven 150 to which assembled panel is transferred and in which sealing step is conducted.

An exhaust pump 141 is connected to the alignment chamber 100, the first substrate baking chamber 110, and the second substrate pre-baking chamber 120, and a valve (not shown) is provided at each connecting part to chambers. With these valves, the chambers can be exhausted independently of one another. In addition, a dry air supplying line 143 is connected to these chambers and dry air can be supplied from the dry air supplying device (not shown) via the dry air supplying line 143.

This supplying and exhausting functions are also provided along the carriage path 140 which connects these chambers. That is, the exhausting function can be realized by using an auxiliary pump 142 and a valve provided for each part of path so that each part can be exhausted independently of one another. Meanwhile, dry air is supplied via the dry air supplying line 143 in the same manner as in the chambers. In addition, a valve is provided at each connecting part between the dry air supplying line and these chambers and between the dry air supplying line and each part of the carrying path.

Furthermore, this apparatus includes the substrate carrying mechanism, the heating mechanism, the substrate supporting mechanism, and the shutters shown in FIG. 3 or FIG. 5 (all not shown).

In this way, this apparatus enables the first and the second substrates to be placed under a reduced pressure or in dry air in the alignment step and the preceding step. Therefore, this apparatus can reduce the amount of water and gaseous molecules, which are absorbed into the both substrates after finishing each of the first and the second substrates and until the sealing step, to a minimum.

In this apparatus, the chambers 100, 110, and 120 are connected via the carrying path. However, intermediate chambers may be provided on the carrying path so as to control conditions on temperature and gas pressure in the intermediate chambers independently of the outside and the chambers for processing (i.e., chambers 100, 110, and 120). Thereby, an environment for the substrate can be controlled before carrying the substrate into a chamber from the outside or before carrying the substrate out of the chamber into another chamber. With this construction, various conditions such as a pressure in the chamber, dew-point, flow rate, and temperature of dry gas can be controlled easily and promptly, which improves productivity of PDPs.

Figure 7:
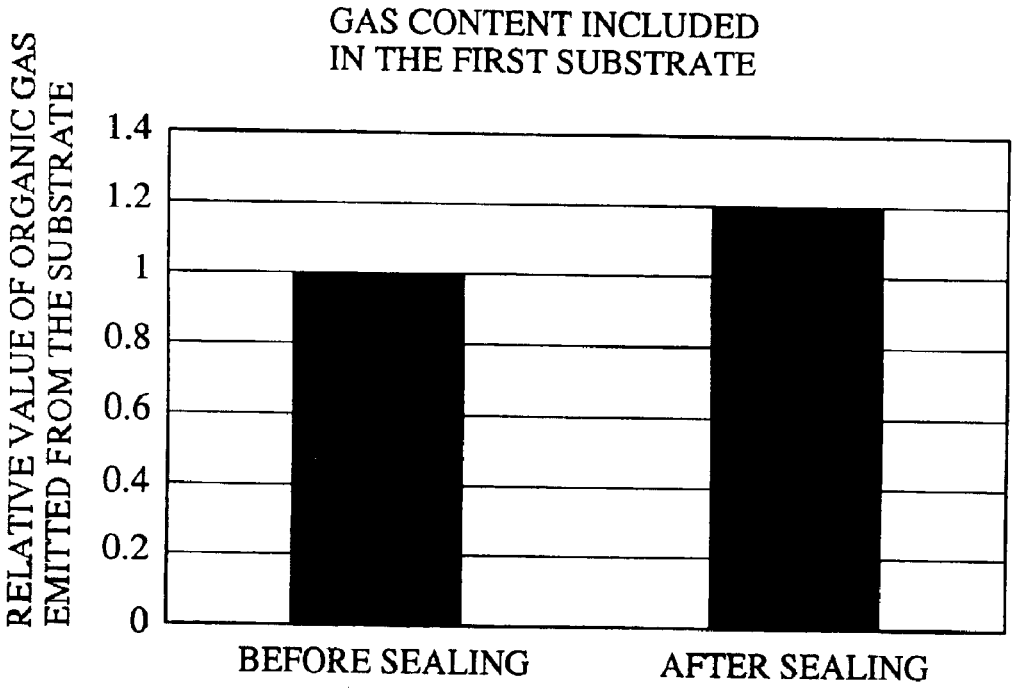
FIG. 7 shows the amount of an organic gas remaining on the surface of the first substrate when a sealing step for comparison to the third and the fifth embodiments is conducted.

Now, for information, FIG. 7 shows a comparison of the total amounts of an organic gas included in the first substrate before the sealing step and that of the first substrate after the sealing step, when the first substrate and the second substrate are baked in the same chamber with the both substrates being opposed to each other. Here, the amount of the gas included in the substrate can be obtained by heating the substrate and measuring the amount of the gas which is emitted from the substrate (this method is called a "programmed temperature gas chromatography method)").

As shown in FIG. 7, the amount of gas from the substrate after the sealing step is 1.2 times that from the substrate before the step. It can be thought that the gas from the seal member on the second substrate is absorbed into the first substrate. Therefore, it is preferable to bake the first and the second substrates with the both substrates being separated as far as possible. The best method is to bake the both substrates in the different chambers as in the above embodiment.

Here, it is possible to combine the above embodiments. For example, the first substrate may be heated under a reduced pressure, while the second may be placed in dry gas.

As described above, the manufacturing method and the manufacturing apparatus according to the invention can reduce the amount of water and gaseous molecules which are absorbed in the first and the second substrates to a minimum by keeping the atmosphere of the first and the second substrates under a reduced pressure or in dry gas, which prevents a degradation of the discharge gas filling the finished panel. As a result, problems such as increase in a discharge starting voltage and generation of an abnormal discharge phenomenon during light-emitting can be prevented.

INDUSTRIAL APPLICABILITY

The invention is applicable to a manufacturing method for gas discharge panels such as PDPs.

What is claimed is:

1. A manufacturing method for a gas discharge panel that has a first substrate on which a protective layer is formed and a second substrate on which phosphor layers are formed, the manufacturing method comprising an alignment step for arranging the first substrate and the second substrate at predetermined locations, while opposing the first substrate and the second substrate, wherein the alignment step is conducted under a reduced pressure and wherein the first substrate is placed under the reduced pressure and heated, and the second substrate is placed in dry gas, before the alignment step is conducted.

2. The manufacturing method for the gas discharge panel of claim 1, wherein the first substrate is placed under a reduced pressure and heated in a first reduced pressure chamber and the second substrate is placed under a reduced pressure and heated in a second reduced pressure chamber, prior to the alignment step in which the first and the second substrates are aligned under a reduced pressure in a third reduced pressure chamber.

3. The manufacturing method for the gas discharge panel of claim 2, wherein, after the protective layer is formed on the first substrate, the first substrate is subjected to a first substrate baking step in which the first substrate is placed under the reduced pressure and heated in the first reduced pressure chamber.

4. The manufacturing method for the gas discharge panel of claim 2, wherein the second substrate is formed by a phosphor layers forming step, a phosphor layers baking step, a seal member applying step, and a seal member pre-baking step, and the second substrate is placed under the reduced pressure and heated in the second reduced pressure chamber part way through the seal member pre-baking step.

5. The manufacturing method for the gas discharge panel of claim 4, wherein the first and the second reduced pressure chambers are each reduced to a pressure of 1,333 Pa or less.

6. A manufacturing method for a gas discharge panel that has a first substrate on which a protective layer is formed and a second substrate on which phosphor layers are formed, the manufacturing method comprising an alignment step for arranging the first substrate and the second substrate at predetermined locations, while opposing the first substrate and the second substrate, wherein the alignment step is conducted in dry gas and wherein the first substrate is placed under reduced pressure and heated, and the second substrate is placed in dry gas, before the alignment step is conducted.

* * * * *